US011259122B2

(12) United States Patent
Clissold-Bate et al.

(10) Patent No.: US 11,259,122 B2
(45) **Date of Patent: *Feb. 22, 2022**

(54) MAGNETIC DISTRIBUTED MODE ACTUATORS AND DISTRIBUTED MODE LOUDSPEAKERS HAVING THE SAME

(71) Applicant: Google LLC, Mountain View, CA (US)

(72) Inventors: James Clissold-Bate, Cambridge (GB); Mark William Starnes, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 26 days.

This patent is subject to a terminal disclaimer.

(21) Appl. No.: 16/876,796

(22) Filed: May 18, 2020

(65) Prior Publication Data

US 2020/0344552 A1 Oct. 29, 2020

Related U.S. Application Data

(63) Continuation of application No. 16/289,553, filed on Feb. 28, 2019, now Pat. No. 10,674,270.

(Continued)

(51) Int. Cl.
*H04R 7/04* (2006.01)
*H04R 9/02* (2006.01)

(Continued)

(52) U.S. Cl.
CPC ..... *H04R 7/045* (2013.01); *H04R 1/24* (2013.01); *H04R 1/2811* (2013.01); *H04R 9/025* (2013.01); *H04R 9/06* (2013.01); *H04R 2499/11* (2013.01)

(58) Field of Classification Search
CPC ..... H04R 1/24; H04R 1/2811; H04R 7/045; H04R 9/06; H04R 9/025; H04R 2499/11
See application file for complete search history.

(56) References Cited

U.S. PATENT DOCUMENTS 6,332,029 B1 * 12/2001 Azima ..... H04R 1/021 381/152
6,965,679 B1 11/2005 Bosio et al.
(Continued)

FOREIGN PATENT DOCUMENTS

CN 1969591 5/2011
CN 104507022 4/2015
(Continued)

OTHER PUBLICATIONS

PCT International Preliminary Report on Patentability in International Appln. No. PCT/US2019/057481, dated May 6, 2021, 10 pages.

(Continued)

*Primary Examiner* — Brian Ensey
(74) *Attorney, Agent, or Firm* — Fish & Richardson P.C.

(57) ABSTRACT

A distributed mode actuator (DMA) includes a flat panel extending in a plane and a rigid, elongate member extended parallel to the plane. The member is mechanically coupled to a face of the flat panel at a point. An end of the member is free to vibrate in a direction perpendicular to the plane. The DMA also includes a magnet and an electrically-conducting coil. Either the magnet or the coil is mechanically coupled to the member. When the coil is energized, an interaction between a magnetic field of the magnet and a magnetic field from the coil applies a force sufficient to displace the member in the direction perpendicular to the plane. The DMA further includes an electronic control module electrically coupled to the coil and programmed to energize the coil to vibrate the member to produce an audio response from the flat panel.

20 Claims, 10 Drawing Sheets

Related U.S. Application Data

(60) Provisional application No. 62/750,187, filed on Oct. 24, 2018.

(51) Int. Cl.

| | |
|---|---|
| ***H04R 1/24*** | (2006.01) |
| ***H04R 1/28*** | (2006.01) |
| ***H04R 9/06*** | (2006.01) |

(56) References Cited

U.S. PATENT DOCUMENTS

| | | | | |
|---|---|---|---|---|
| 8,594,362 | B2 * | 11/2013 | Liu | H04R 9/045 381/396 |
| 9,660,596 | B2 | 5/2017 | Whitewell | |
| 10,264,348 | B1 * | 4/2019 | Harris | G06F 3/0488 |
| 10,674,270 | B2 | 6/2020 | Clissold-Bate et al. | |
| 2003/0059069 | A1 | 3/2003 | Bank et al. | |
| 2005/0031155 | A1 | 2/2005 | Bachman et al. | |
| 2006/0008099 | A1 | 1/2006 | Azima et al. | |
| 2007/0263886 | A1 | 1/2007 | Starnes et al. | |
| 2012/0250928 | A1 | 10/2012 | Prance et al. | |
| 2013/0148840 | A1 | 6/2013 | Liu | |
| 2018/0014126 | A1 | 1/2018 | Boyd | |

FOREIGN PATENT DOCUMENTS

| | | |
|---|---|---|
| CN | 102484756 | 6/2016 |
| CN | 108282724 | 7/2018 |
| EP | 2449794 | 5/2012 |
| WO | WO 2007/083127 | 7/2007 |
| WO | WO 2018/147588 | 8/2018 |

OTHER PUBLICATIONS

CN Office Action in Chinese Appln. No. 201980036126.5, dated Jun. 3, 2021, 7 pages (with English translation).

PCT International Search Report and Written Opinion in International Appln. No. PCT/US2019/057481, dated Mar. 16, 2020, 6 pages.

Rashedin, "A novel miniature matrix array transducer system for loudspeakers," IEEE Xplore, Sep. 25, 2006, 3 pages.

TW Office Action in Taiwan Appln. No. 108138224, dated Feb. 17, 2021, 13 pages (with English translation).

* cited by examiner

MAGNETIC DISTRIBUTED MODE ACTUATORS AND DISTRIBUTED MODE LOUDSPEAKERS HAVING THE SAME

CROSS-REFERENCE TO RELATED APPLICATIONS

This application is a continuation of U.S. application Ser. No. 16/289,553, filed Feb. 28, 2019, which claims the benefit of U.S. Provisional Application Ser. No. 62/750,187, filed on Oct. 24, 2018, the contents of each are incorporated by reference herein.

BACKGROUND

This specification relates to magnetic distributed mode actuators (magnetic DMAs) and distributed mode loudspeakers (DMLs) that feature magnetic DMAs.

Many conventional loudspeakers produce sound by inducing piston-like motion in a diaphragm. Panel audio loudspeakers, such as distributed mode loudspeakers (DMLs), in contrast, operate by inducing uniformly distributed vibrational modes in a panel through an electro-acoustic actuator. Typically, the actuators are electromagnetic or piezoelectric actuators.

SUMMARY

This specification discloses distributed mode actuators (magnetic DMAs) that include a magnetic circuit. For example, embodiments of such magnetic DMAs can include a magnetic circuit that features a coil and a permanent magnet coupled to an inertial beam. Vibrational modes are excited in the inertial beam by energizing the coil of the magnetic circuit. By attaching the magnetic DMA to a mechanical load, such as an acoustic panel, the magnetic DMA can be used to drive the panel in a manner similar to a conventional piezoelectric based magnetic DMA.

In general, in a first aspect, the invention features a distributed mode loudspeaker that includes a flat panel extending in a plane. The distributed mode loudspeaker also includes a rigid, elongate member extended along a direction parallel to the plane, the member being mechanically coupled to a face of the flat panel at a point, the member extending beyond the point to an end of the member free to vibrate in a direction perpendicular to the plane. The distributed mode loudspeaker further includes a magnet and an electrically-conducting coil, wherein either the magnet or the electrically-conducting coil is mechanically coupled to the member and the magnet and electrically-conducting coil are arranged relative to one another so that, when the electrically-conducting coil is energized, an interaction between a magnetic field of the magnet and a magnetic field from the electrically-conducting coil applies a force sufficient to displace the member in the direction perpendicular to the plane. The distributed mode loudspeaker also includes an electronic control module electrically coupled to the electrically-conducting coil and programmed to energize the coil to vibrate the member at frequencies and amplitudes sufficient to produce an audio response from the flat panel.

Implementations of the distributed mode loudspeaker can include one or more of the following features and/or one or more features of other aspects. For example, the flat panel can include a flat panel display.

In some implementations, the member is mechanically coupled at a second end of the member opposite the free end. In other implementations, the member is mechanically coupled to the flat panel by a rigid element that displaces the member from the face of the flat panel. The member can include a non-magnetic material. In some implementations, the electrically-conducting coil is attached to the member and the magnet is attached to a housing for the distributed mode loudspeaker.

In some implementations, the member has a length in a range from about 1 cm to about 10 cm and a thickness of 5 mm or less. The member can include a non-magnetic material. The size and stiffness of the member can be chosen such that the distributed mode loudspeaker has a resonance frequency in a range from about 200 Hz to about 500 Hz.

In some implementations, the magnet is a permanent magnet, while in other implementations, the magnet is an electromagnet.

In other implementations, the distributed mode loudspeaker further includes one or more additional electrically-conducting coils and corresponding magnets. For each additional electrically-conducting coil and magnet, either the magnet or the electrically-conducting coil is mechanically coupled to the member and the magnet and electrically-conducting coil are arranged relative to one another so that, when the electrically-conducting coil is energized, an interaction between a magnetic field of the magnet and a magnetic field from the electrically-conducting coil apply a force sufficient to displace the member in the direction perpendicular to the plane.

In some implementations, each of the electrically-conducting coil and magnet pair are located at different positions with respect to the member, the positions being selected based on vibrational modes of the member.

In another aspect, a mobile device can include the distributed mode actuator, in addition to a housing and a display panel mounted in the housing. The mobile device can be a mobile phone or a tablet computer.

In yet another aspect, a wearable device can include the distributed mode actuator, in addition to a housing and a display panel mounted in the housing. The wearable device can be a smart watch or a head-mounted display.

Among other advantages, embodiments feature magnetic DMAs that are free of certain toxic chemicals, such as lead, which are present in some conventional magnetic DMAs. For example, conventional magnetic DMAs typically use piezoelectric materials, many of which include the element lead. In contrast, exemplary magnetic DMAs contain no lead, but can achieve similar performance to the conventional piezoelectric magnetic DMAs.

In some implementations, electromagnetic DMA systems can provide a stronger output than conventional piezoelectric magnetic DMAs, when driven by the same current, owing to the strong magnetic fields generated by the electromagnetic DMA system.

Furthermore, the subject matter can generate a modal force and velocity output that can complement the modal response of a resonant panel, resulting in a smoother audio response versus frequency than can be attained by driving the resonant panel using a conventional actuator that provides a constant force.

In addition, the electromagnetic actuator system can be designed so as to exhibit a smaller capacitance as compared to a conventional piezoelectric magnetic DMA, which displays a capacitive load. By comparison, a magnetic DMA exhibits an inductive load, which can result in more efficient power transfer to the device at low frequencies compared to piezoelectric DMAs driven at the same low frequency.

The resonant portion of the magnetic DMA can be constructed from materials much less brittle than the materials used in PZT magnetic DMAs for example metals, resulting in a more rugged device.

While a magnetic DMA can include one or more permanent magnets or a combination of electromagnets and permanent magnets, implementations that feature a combination of electromagnets and permanent magnets can operate above the Curie temperatures of DMAs that feature piezoelectric materials or DMAs that feature permanent magnets and no electromagnets.

BRIEF DESCRIPTION OF THE DRAWINGS

Like reference symbols in the various drawings denote like components.

DETAILED DESCRIPTION

Figure 1:
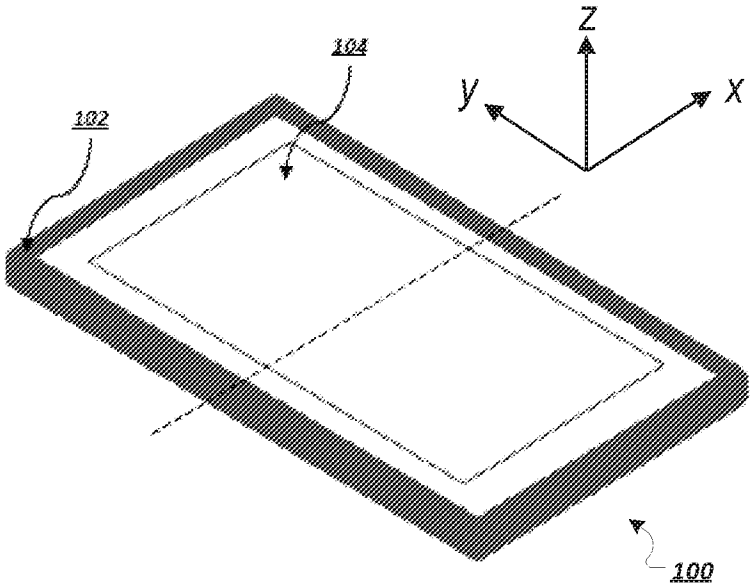
FIG. 1 is a perspective view of an embodiment of a mobile device.

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104, or simply panel 104, which includes a flat panel display (e.g., an OLED or LCD display panel) that integrates a panel audio loudspeaker. Mobile device 100 interfaces with a user in a variety of ways, including by displaying images and receiving touch input via panel 104. Typically, a mobile device has a depth of approximately 10 mm or less, a width of 60 mm to 80 mm (e.g., 68 mm to 72 mm), and a height of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a distributed mode actuator, or magnetic DMA. The actuator is a movable component arranged to provide a force to a panel, such as panel 104, causing the panel to vibrate. The vibrating panel generates human-audible sound waves, e.g., in the range of 20 Hz to 20 kHz.

In addition to producing sound output, mobile device 100 can also produces haptic output using the actuator. For example, the haptic output can correspond to vibrations in the range of 180 Hz to 300 Hz.

Figure 2:
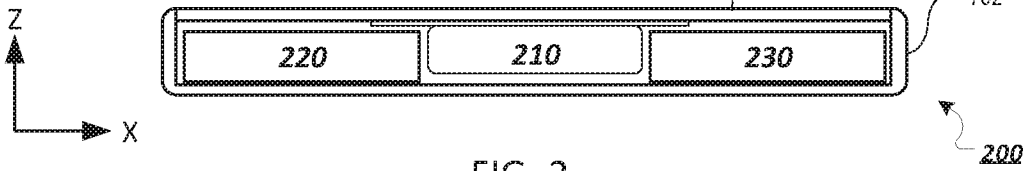
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section 200 of mobile device 100 illustrates device chassis 102 and panel 104. FIG. 2 also includes a Cartesian coordinate system with x, y, and z axes, for ease of reference. Device chassis 102 has a depth measured along the z-direction and a width measured along the x-direction. Device chassis 102 also has a back panel, which is formed by the portion of device chassis 102 that extends primarily in the xy-plane. Mobile device 100 includes an electromagnet actuator 210, which is housed behind display 104 in chassis 102 and affixed to the back side of display 104.

In some implementations, panel 104 is pinned to the chassis at one or more points. This means that, at these points, translational movement of the panel from the chassis is prevented. However, when panel 104 is pinned, it is able to rotate about the one or more points.

In certain implementations, panel 104 is clamped to the chassis at one or more points. That is, at these points, both translation and rotation of panel 104 is prevented.

Generally, electromagnet actuator 210 is sized to fit within a volume constrained by other components housed in the chassis, including an electronic control module 220 and a battery 230. For example, actuator 210 can have a length measured along the x-axis in the range of 1 cm to about 10 cm, and a thickness measured along the z-axis of 5 mm or less.

Figure 3:
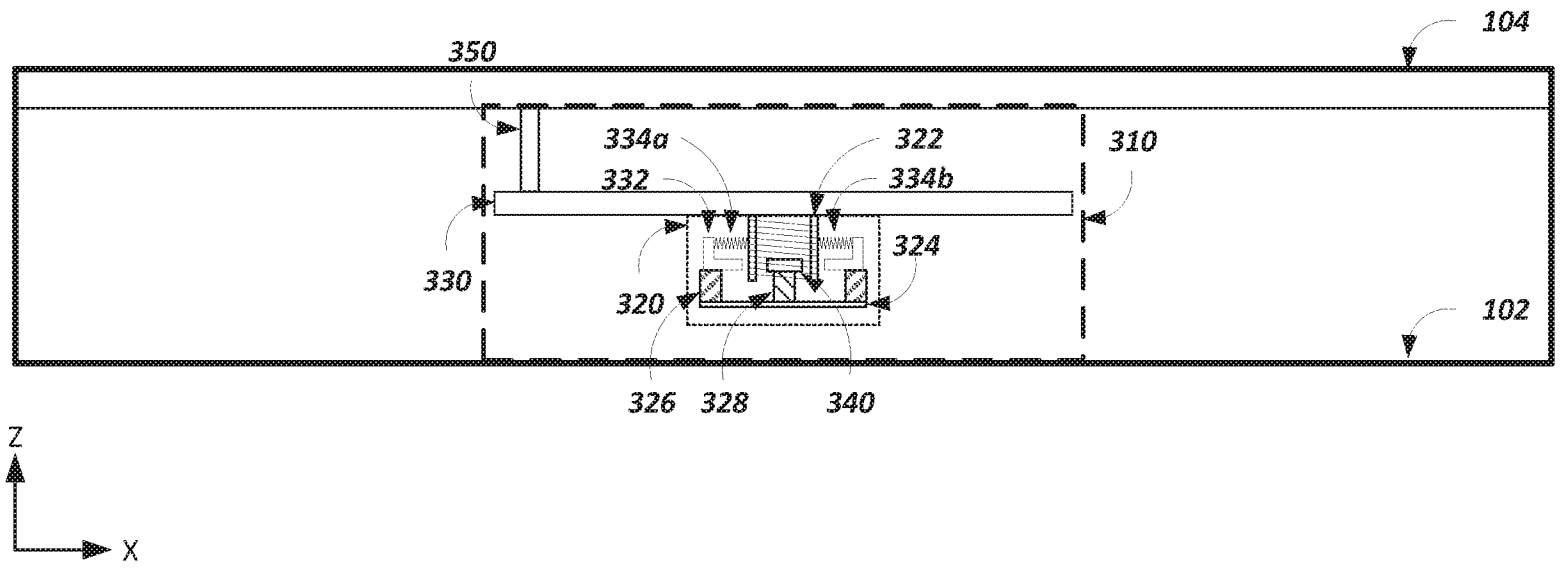
FIG. 3 is a cross-sectional view of an embodiment of a mobile device showing a magnetic DMA that includes an inertial transducer driving a member.

Referring to FIG. 3, an embodiment of a magnetic DMA 310 includes an inertial transducer 320, shown in dotted lines, attached to a member 330, which in turn is attached to panel 104 by a stub 350. An inertial transducer is a transducer that induces vibrations, e.g., in a member to which it is attached, by the inertial effects of a vibrating mass.

Member 330 is a rigid, elongated member with a height and width measured along the z-axis and x-axis, respectively. Although not shown in FIG. 3, member 330 has a length that extends along the y-axis. In some implementations, member 330 is a beam with a width significantly longer than its height or length. In other implementations, member 330 is a plate that has a width and length that are both significantly longer than its height. For example, the height can be from about 2 mm to about 6 mm (e.g., about 2.5 mm or more, about 3.5 mm or more, about 4 mm or more, e.g., about 5.5 mm or less, about 5 mm or less, about 4.5 mm or less), the width can be from about 12 mm to about 20 mm (e.g., about 13 mm or more, about 14 mm or more, about 15 mm or more, about 16 mm or more, e.g., about 19 mm or less, about 18 mm or less, about 17 mm or less), and the length can be from about 6 mm to about 12 mm (e.g., about 7 mm or more, about 8 mm or more, about 9 mm, e.g., about 11 mm or less, about 10 mm or less).

Member 330 is attached to panel 104 at one end by a stub 350. In the example of FIG. 3, member 330 is also attached to coil 322. The attachment of member 330 to stub 350 prevents the portion of the member closest to the stub from moving significantly. While one end of member 330 is attached to stub 350 the opposing end of the member is free to vibrate up and down in the z-direction.

Panel 104 can be permanently connected to stub 350, e.g., such that the removal of panel 104 from stub 350 would likely damage the touch panel display, stub, or both. In some implementations, panel 104 can be removably connected to stub 350 e.g., such that removal of the touch panel display from the stub would likely not damage the touch panel display or the stub. In some implementations, an adhesive is used to connect a surface of panel 104 to stub 350, while in other implementations, a type of fastener is used.

Inertial transducer 320 includes a coil 322 that attaches the transducer to member 330. Inertial transducer 320 also includes a back plate 324, to which a first magnet 326 and a second magnet 328 are attached. First magnet 326 is a ring magnet, e.g., one that is o-shaped when viewed in the xy-plane, while second magnet 328 is a pole magnet. A pole piece 340 is attached to second magnet 328 and is provided to focus the magnetic field generated by first and second magnets 326 and 328 so that the magnetic field passes perpendicular to coil 322, i.e., in the x-direction.

Inertial transducer 320 also includes a front plate 332, which is attached to first magnet 326. Front plate 332 is o-shaped when viewed in the xy-plane. Suspension elements 334*a* and 334*b* attach front plate 332 to coil 322. The shape and material properties of front plate 332 are chosen so as to better direct the magnetic field generated by first and second magnets 326 and 328 in the x-direction, i.e., perpendicular to coil 322.

During the operation of magnetic DMA 310, electronic control module 220 energizes coil 322, such that a current passes through the coil, perpendicular to the magnetic field. It is important for the direction of the magnetic field to be in the x-direction so that the field is perpendicular to the flow of current. The magnetic field exerts a force on the coil, which is displaced in the z-direction as a result. Varying the direction of the current results in the inertial transducer to vibrate exerting a force on the member, which also vibrates in the z-direction. At certain frequencies, the vibration of transducer 320 can cause the member to vibrate at certain desired frequencies.

Stub 350 transfers the force of the vibration from member 330 to panel 104, causing the panel to vibrate. Generally, magnetic DMA 310 can excite various vibrational modes in touch panel 104, including resonant modes. For example, the touch panel display can have a fundamental resonance frequency in a range from about 200 Hz to about 700 Hz (e.g., at about 500 Hz), and one or more additional higher order resonance frequencies in a range from about 5 kHz to about 20 kHz.

Generally, coil 322 can be composed of any electrically conductive material or materials (e.g., copper wire). The first and second magnets 326 and 328 can be any type of permanent magnetic material.

Member 330 can be composed of any material or materials with sufficient rigidity to support desired vibrational modes and manufacturability to be readily formed in a desired shape. Metals, alloys, plastics, and/or ceramics can be used. In some implementations, the material or materials that form the member 330 are non-magnetic, so as not to interact with the magnetic field produced by magnet assembly 312 or coil 322. The member 330 can include one or more materials stacked in the z-direction to affect the mechanical impedance provided by magnetic DMA 310. For example, an internal damping layer of viscoelastic adhesive material, e.g., Tesa tape, sandwiched between layers of stainless-steel can have the effect of damping the movement of member 330.

Figure 4:
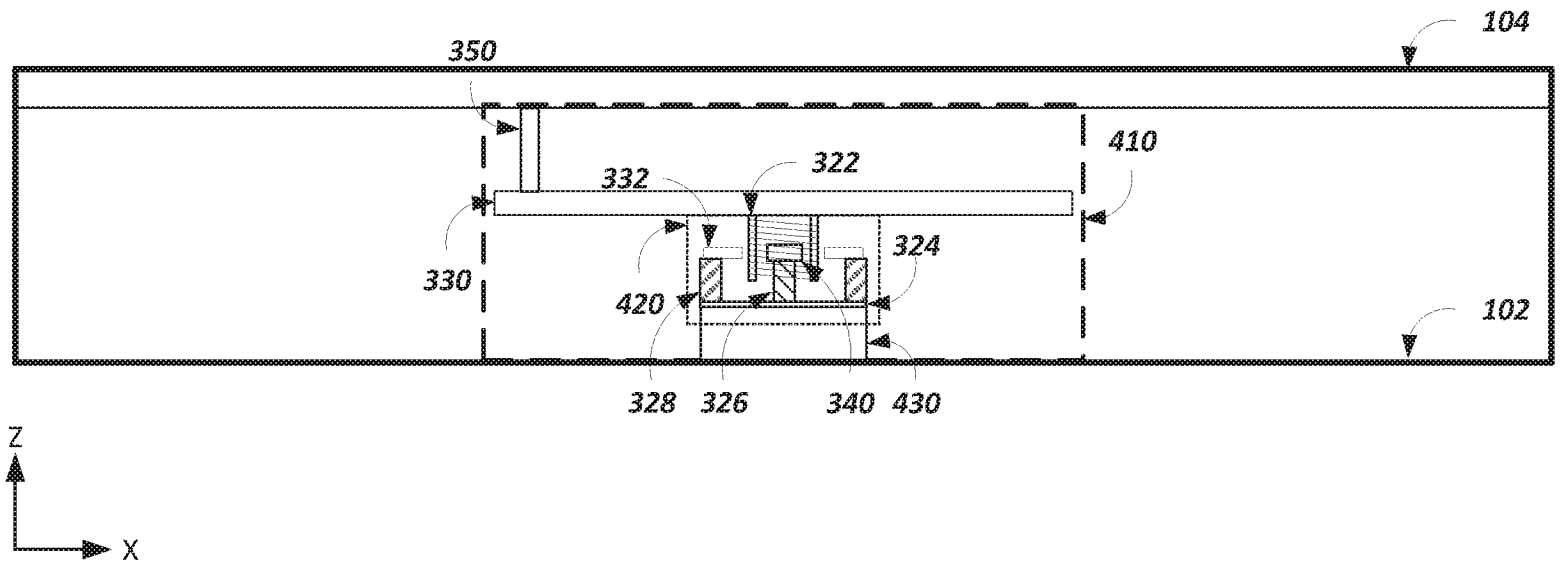
FIG. 4 is a cross-sectional view of an embodiment of a mobile device showing a magnetic DMA that includes a non-inertial transducer driving a member.

While FIG. 3 shows an embodiment of a magnetic DMA 310 that includes an inertial transducer suspended from member 330, FIG. 4 shows a magnetic DMA 410 that includes a non-inertial transducer 420, or simply transducer 420, which is attached to both member 330 and a mechanical ground 430. Like transducer 320, transducer 420 includes coil 322 attached to member 330, first and second magnets 326 and 328 attached to back plate 324, pole piece 340 attached to second magnet 328, and front plate 332 attached to first magnet 326. Unlike transducer 320, transducer 420 does not include suspension elements 334*a* and 334*b*. Although, in other implementations, a magnetic DMA can include the components of transducer 420 as well as one or more suspension elements that act to position coil 322 in the air gap formed between first and second magnets 326 and 328.

Transducer 420 is attached to mechanical ground 430; therefore, during operation of magnetic DMA 420, when coil 322 is energized and the magnetic field of first and second magnets 326 and 328 exerts a force on the coil, only the coil and the attached member 330 moves in response to the force. The force generated by the vibration of member 330 is transferred to panel 104 by stub 350, causing the panel to vibrate.

FIG. 4 shows an embodiment in which coil 322 is attached below member 330, although in some implementations, coil 322 is attached above member 330. That is, transducer 420 and mechanical ground 430 are reflected across a horizontal axis parallel to the x-axis. Accordingly, a first face of mechanical ground 430 is attached to panel 104 while a second face, opposite to the first face, is attached to back panel 324.

Figure 5:
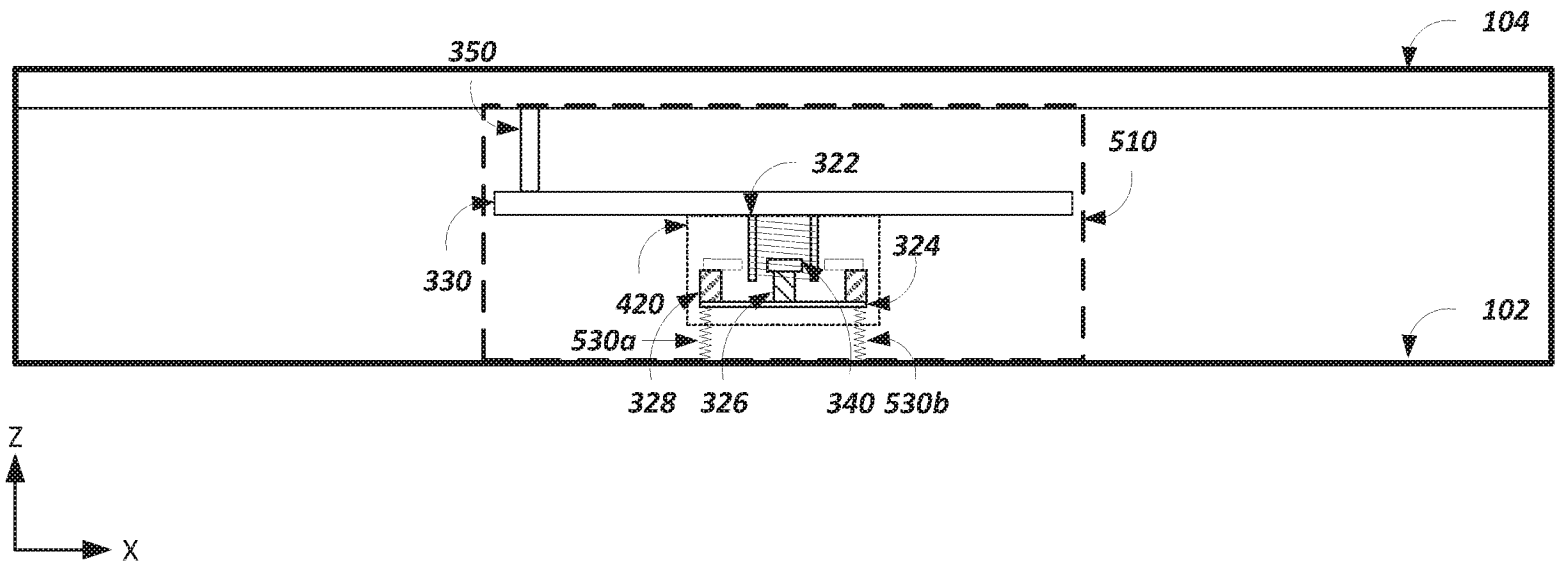
FIG. 5 is a cross-sectional view of an embodiment of a mobile device showing a magnetic DMA that includes a transducer attached to a spring.

Instead of being attached to a mechanical ground, in some implementations, transducer 420 is attached to one or more suspension elements. FIG. 5 shows an embodiment of a magnetic DMA 510 that includes transducer 420 attached to suspension elements 530*a* and 530*b*. Each suspension element 530*a* and 530*b* is also attached to chassis 102. Like suspension elements 334*a* and 334*b*, which allow transducer 320 to vibrate in the z-direction, suspension elements 530*a* and 530*b* allow transducer 420 to be vibrate in the z-direction, which can cause member 330 to vibrate at certain desired frequencies.

Figure 6:
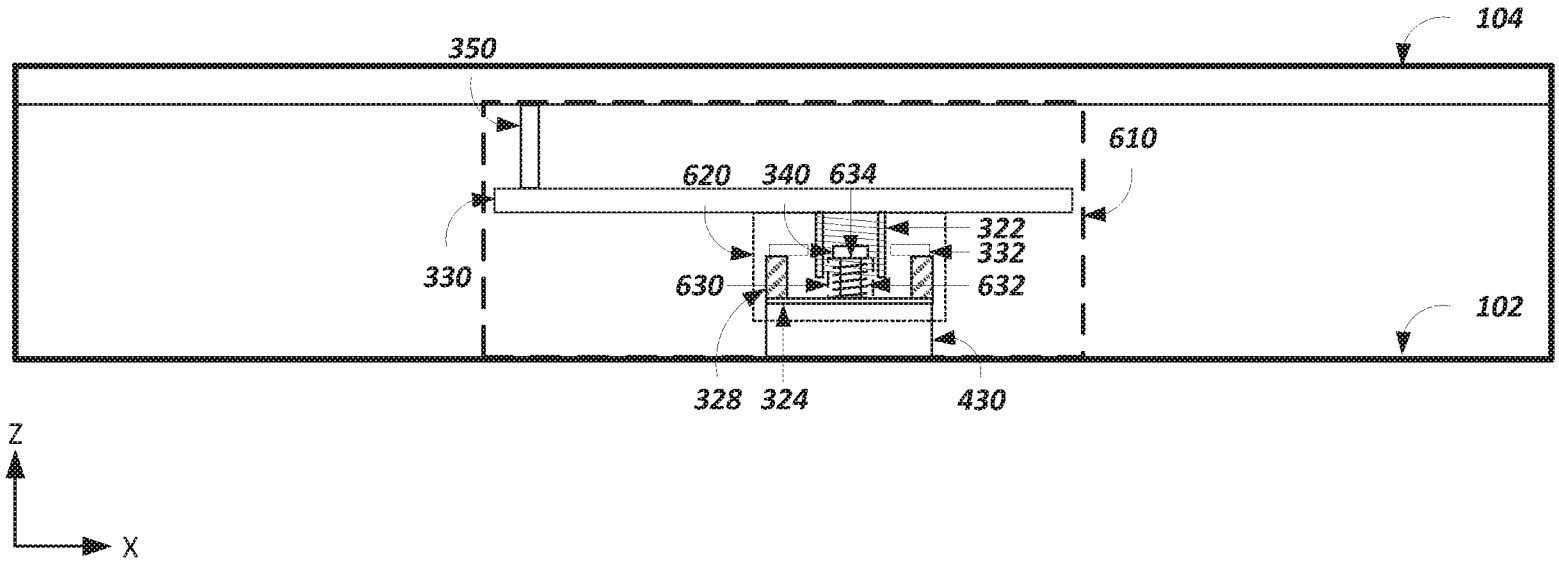
FIG. 6 is a cross-sectional view of an embodiment of a mobile device showing a magnetic DMA that includes an electromagnet and a coil attached to a member.

While FIGS. 3-5 show DMAs that include a permanent magnet (i.e., second magnet 328) positioned in a space formed by coil 322, in some implementations, the permanent magnet is replaced by an electromagnet assembly. For example, referring to FIG. 6, a DMA 610 includes a transducer 620 which, like transducers 320 and 420, includes a back plate 324 that supports second magnet 328. Also like transducers 320 and 420, transducer 620 includes a front plate 332 that is attached to second magnet 328. While transducers 320 and 420 include a first magnet 326, which is a permanent magnet, actuator 620 includes an electromagnet assembly 630, shown in dashed lines. Electromagnet assembly 630 includes a second coil 632 and a core 634.

Second coil 632 is essentially identical to coil 322, with the exception of the size and placement of the two coils. Second coil 632 is smaller than coil 322 so that it fits within the interior space formed by coil 322. While coil 322 is attached to member 330, second coil 632 wraps around core 634. When second coil 632 is energized, e.g., by a DC current, a magnetic field is induced that surrounds the second coil.

Core 634 focuses the induced magnetic field so that the portion of the field that passes through the interior space formed by coil 632 is directed primarily in the z-direction. Core 634 can be any material (e.g., iron) having a high magnetic permeability. Actuator 620 also includes a pole piece 340 that is attached to core 634 and is provided to focus the magnetic field generated by second magnet 328 and electromagnet assembly 630 (e.g., the portion that extends outside of the interior space formed by coil 632) so that the magnetic field passes perpendicular to coil 322, i.e., in the x-direction.

During operation of DMA 610, electronic control module 220 energizes coil 322 and the magnetic field generated by second coil 632 and second magnet 328 exerts a force on coil 322. In response to the force, coil 322 and the attached member 330 are displaced in the z-direction. By energizing coil 322 with an AC current, member 330 vibrates in the z-direction and the vibration of the member is transferred to panel 104 by stub 350, causing the panel to vibrate.

In some implementations, electronic control module 220 energizes second coil 632 using an AC signal. For example, the AC signal that drives second coil 632 can be the same AC signal that is applied to coil 322. As another example, the phases of the AC signals that drive coil 322 and second coil 632 can be offset from one another, e.g., so as to maximize the force generated on member 330.

While transducer 620 includes a back plate 324 that attaches core 634 and second magnet 328 to mechanical ground 430, in some implementations, back plate 324 is omitted and core 634 and second magnet 328 are attached directly to mechanical ground 430.

While FIGS. 3-6 show embodiments of mobile devices that include magnetic DMAs having a single transducer, more generally, multiple transducers can be used. Having multiple transducers can increase the range of frequencies at which a member vibrates and can facilitate the vibration of a front display panel into a particular vibrational mode. For example, referring to FIG. 7A, a magnetic DMA 710 includes two transducers, 720*a* and 720*b*. Each transducer 720*a* and 720*b* has the same components described with regard to transducer 420. Transducers 720*a* and 720*b* are attached to mechanical grounds 730*a* and 730*b*, respectively.

Figure 7A:
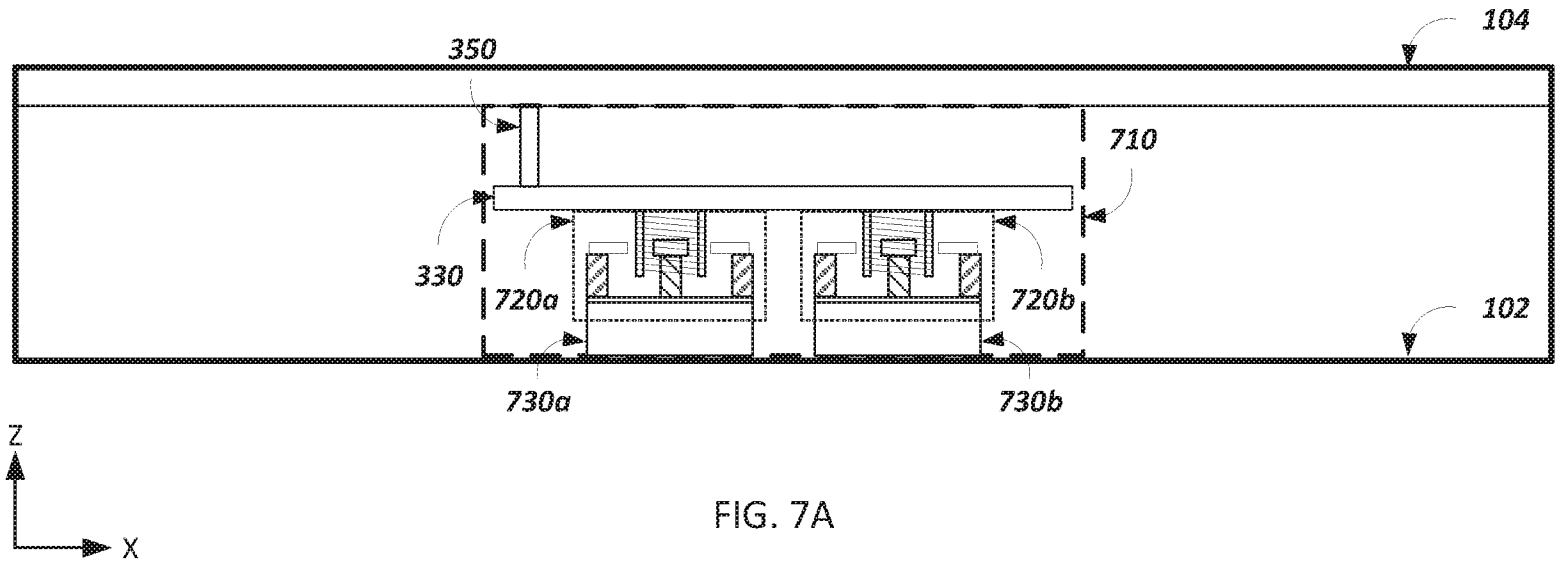
FIG. 7A is a cross-sectional view of an embodiment of a mobile device showing multiple magnetic DMAs attached to different locations of a member, the different locations being on the same side of the member.

While FIG. 7A shows a mobile device that has two transducers, both positioned below member 330, other placements of the transducers is possible. For example, both transducers can be placed above member 330, e.g., attached to a mechanical ground, which in turn is attached to panel 104. As another example, one transducer can be positioned above member 330, while a second transducer can be positioned below the member.

One particular advantage of an actuator having both transducers positioned above a member is that such an actuator occupies less space compared to an actuator having transducers on opposite sides of the member, or transducers below the member.

Figure 7B:
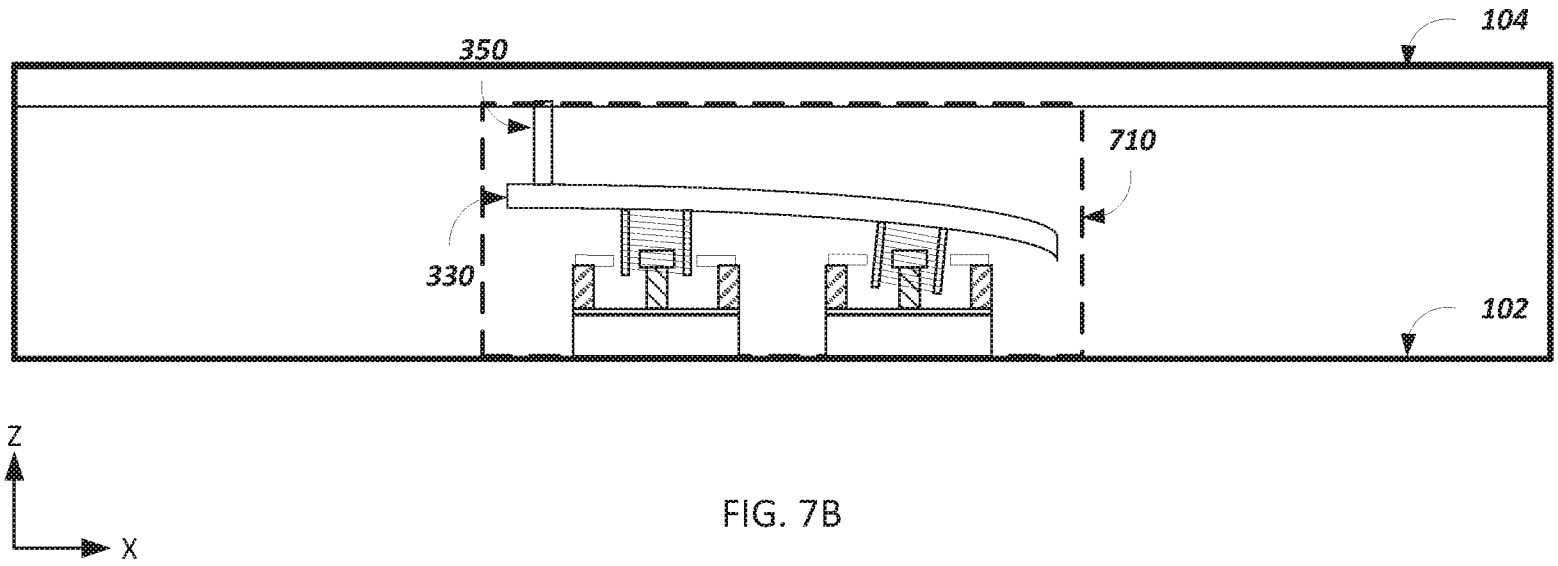
FIG. 7B is a cross-sectional view of the embodiment of the mobile device shown in FIG. 7A showing an actuation scheme that excites a fundamental mode of the member with one end closed.

FIG. 7B shows a cross section of the mobile device shown in FIG. 7A. FIG. 7B shows magnetic DMA 710 during the operation of transducer 720*b*, that is, while the coil of the transducer is energized and a force is exerted on the coil. The force exerted on the coil of transducer 720*b* causes member 330 to be displaced, by virtue of its attachment to the coil, as shown in FIG. 7B. To better illustrate how member 330 is displaced by the operation of transducer 720*b*, FIG. 7B shows a significant displacement from the rest position shown in FIG. 7A. It should be noted that the displacement of member 330 at the free end is on the order of 1 mm. Therefore, the coils of transducers 720*a* and 720*b* are not significantly rotated nor does the rotation of the coils significantly impact the operation of the transducers or the vibration of member 330.

FIG. 7B shows member 330 in a fundamental vibrational mode of operation with one end closed. That is, the portion of the member closest to stub 350 experiences zero z-direction displacement (i.e., this end remains closed), while the portion farthest from stub 350 experiences maximum z-direction displacement (i.e., this end remains open).

In general, electronic control module 220 generates a driving current that controls the magnetic DMA. In some implementations, the driving current that passes through the coil of the magnetic DMA is an alternating current, causing member 330 to vibrate in the z-direction at a frequency that approximately matches the frequency of the alternating current. In some implementations, a rectified alternating current drives the magnetic DMA. As an example, driving a magnetic DMA with a rectified current can causing member 330 to reach a maximum displacement at the peak of the rectified alternating current, and return to the rest position at the minimum value of the rectified alternating current.

Figure 7C:
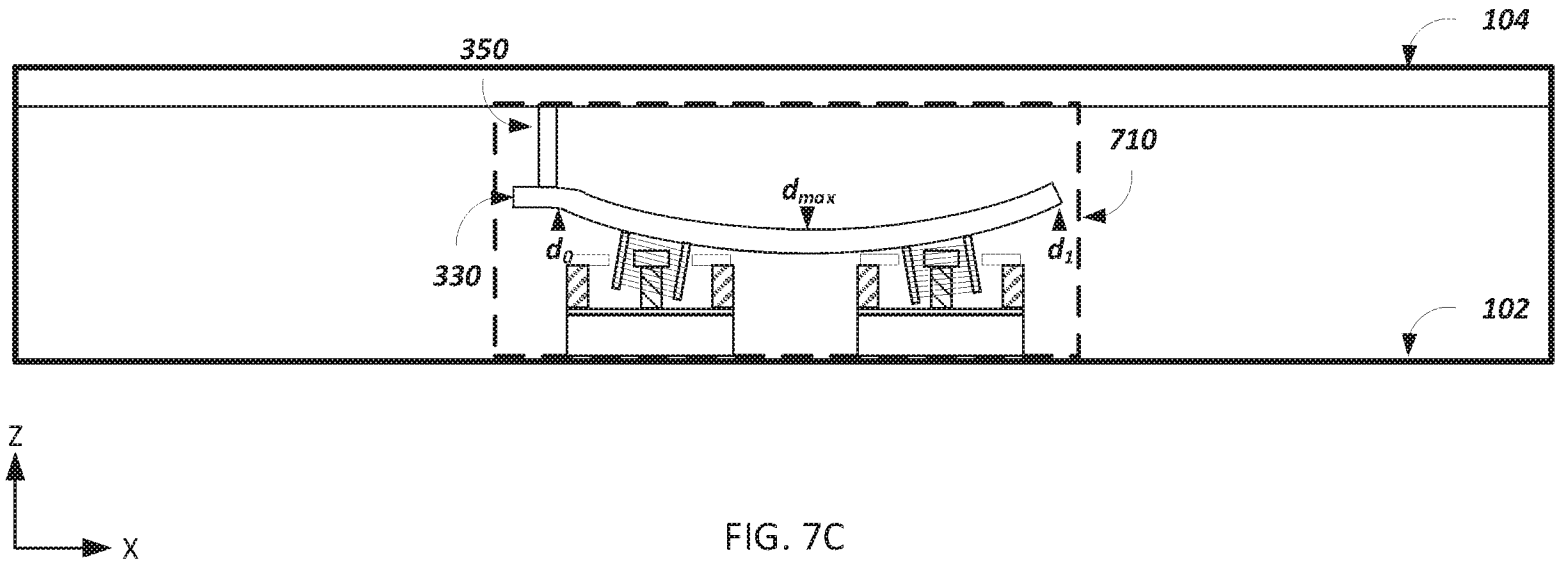
FIG. 7C is a cross-sectional view of the embodiment of the mobile device shown in FIGS. 7A-7B showing an actuation scheme that excites a fundamental mode of the member with both ends closed.

Referring to FIG. 7C, a cross section shows the mobile device shown in FIGS. 7A-7B, with member 330 in a fundamental vibrational mode of operation with both ends closed. FIG. 7C also shows three points of interest with regard to the fundamental mode of operation, labeled $d_0$, $d_1$, and $d_{max}$. The point $d_0$ is positioned adjacent to stub 350, in the direction of the far end of member 330. The point $d_1$ is positioned at the end of member 330 that is farthest away from stub 350. Finally, the point $d_{max}$ is positioned at the midpoint between $d_0$ and $d_1$.

The fundamental mode of operation, as shown in FIG. 7C, is characterized by zero z-direction displacement of member 330 at $d_0$ and $d_1$ (i.e., the closed ends), and maximum z-direction displacement at $d_{max}$.

Figure 7D:
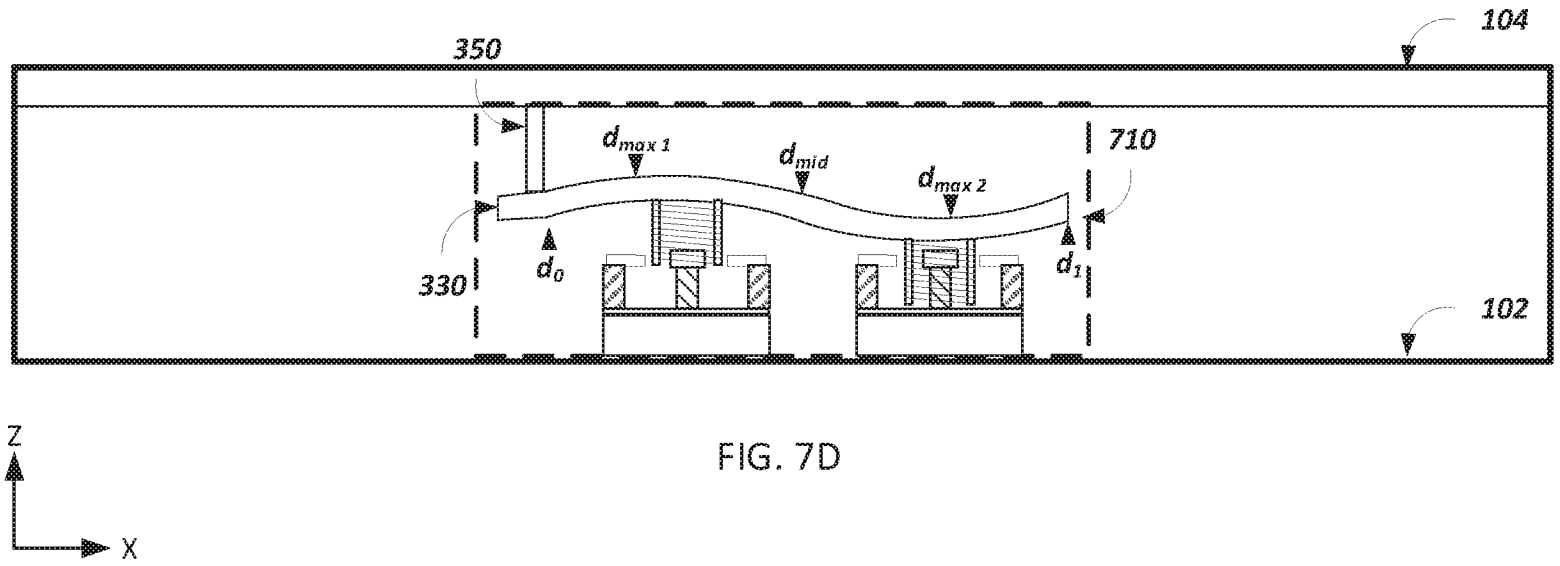
FIG. 7D is a cross-sectional view of the embodiment of the mobile device shown in FIGS. 7A-7C showing an actuation scheme that excites a first higher order mode of the member.

Referring to FIG. 7D, a cross section shows the mobile device shown in FIGS. 7A-7C, with member 330 in a first higher order vibrational mode of operation. The first higher order vibrational mode of operation is characterized by two points of maximum displacement in the z-direction, $d_{max\ 1}$ and $d_{max\ 2}$. When member 330 vibrates in the first higher order mode of operation, the points $d_{max\ 1}$ and $d_{max\ 2}$ experience maximum displacement, while $d_0$, $d_1$, and $d_{mid}$, the midpoint between $d_0$ and $d_1$, experience zero displacement in the z-direction.

In general, the positions of the coils can be selected based on vibrational modes of member 330. That is, the transducers can be positioned so as to require a relatively low amount of energy to excite member 330 into the fundamental, first higher order, or other vibrational modes, compared to alternative placements of the pair.

Figure 8:
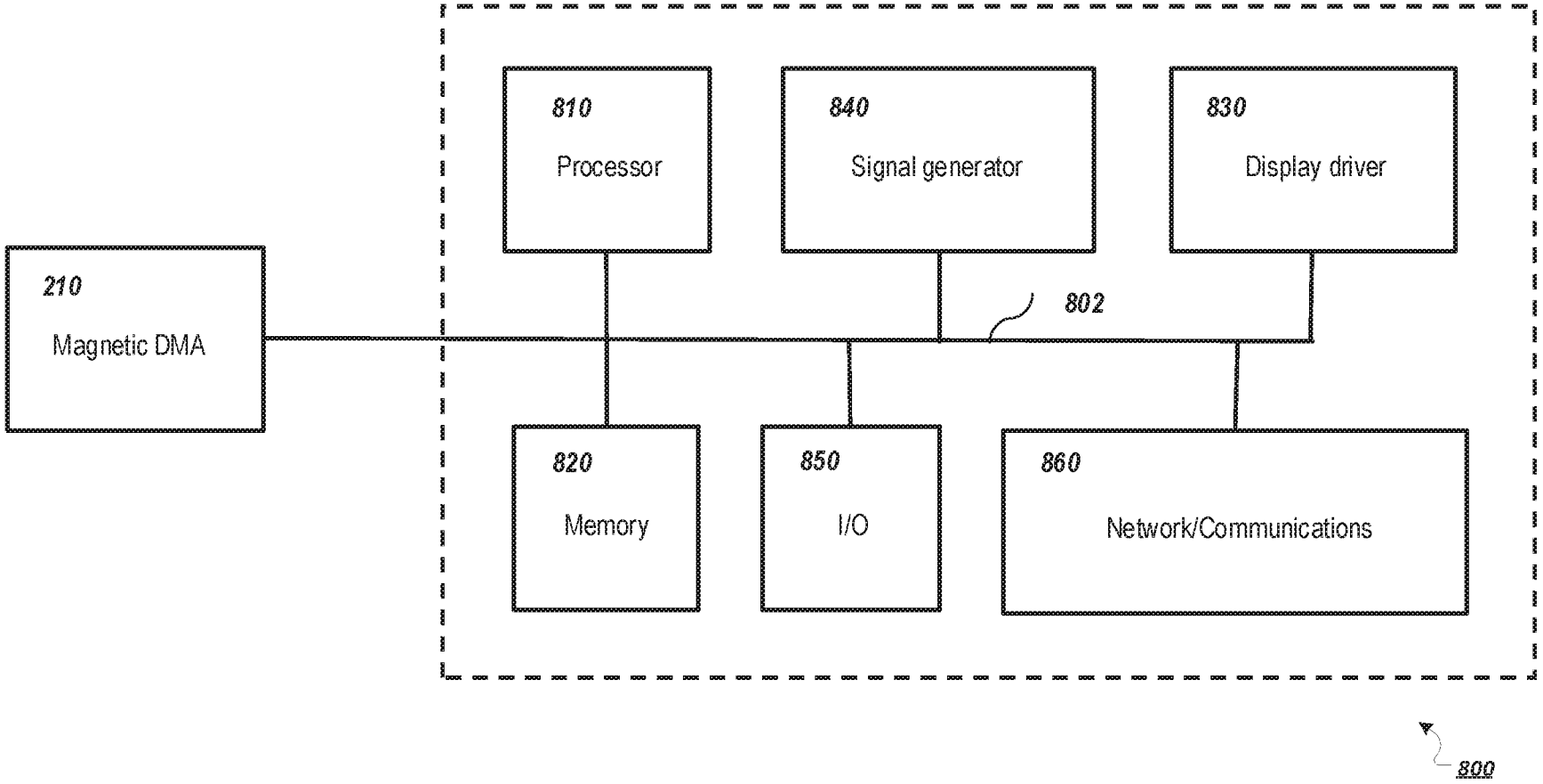
FIG. 8 is a schematic diagram of an embodiment of an electronic control module for a mobile device.

In general, the disclosed actuators are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 8, an exemplary electronic control module 800 of a mobile device, such as mobile device 100, includes a processor 810, memory 820, a display driver 830, a signal generator 840, an input/output (I/O) module 850, and a network/communications module 860. These components are in electrical communication with one another (e.g., via a signal bus 802) and with actuator 210.

Processor 810 may be implemented as any electronic device capable of processing, receiving, or transmitting data or instructions. For example, processor 810 can be a microprocessor, a central processing unit (CPU), an application-specific integrated circuit (ASIC), a digital signal processor (DSP), or combinations of such devices.

Memory 820 has various instructions, computer programs or other data stored thereon. The instructions or computer programs may be configured to perform one or more of the operations or functions described with respect to the mobile device. For example, the instructions may be configured to control or coordinate the operation of the device's display via display driver 830, signal generator 840, one or more components of I/O module 850, one or more communication channels accessible via network/communications module 860, one or more sensors (e.g., biometric sensors, temperature sensors, accelerometers, optical sensors, barometric sensors, moisture sensors and so on), and/or actuator 210.

Signal generator 840 is configured to produce AC waveforms of varying amplitudes, frequency, and/or pulse profiles suitable for actuator 210 and producing acoustic and/or haptic responses via the actuator. Although depicted as a separate component, in some embodiments, signal generator 840 can be part of processor 810. In some embodiments, signal generator 840 can include an amplifier, e.g., as an integral or separate component thereof.

Memory 820 can store electronic data that can be used by the mobile device. For example, memory 820 can store electrical data or content such as, for example, audio and video files, documents and applications, device settings and user preferences, timing and control signals or data for the various modules, data structures or databases, and so on. Memory 820 may also store instructions for recreating the various types of waveforms that may be used by signal generator 840 to generate signals for actuator 210. Memory 820 may be any type of memory such as, for example, random access memory, read-only memory, Flash memory, removable memory, or other types of storage elements, or combinations of such devices.

As briefly discussed above, electronic control module 800 may include various input and output components represented in FIG. 8 as I/O module 850. Although the components of I/O module 850 are represented as a single item in FIG. 8, the mobile device may include a number of different input components, including buttons, microphones, switches, and dials for accepting user input. In some embodiments, the components of I/O module 850 may include one or more touch sensor and/or force sensors. For example, the mobile device's display may include one or more touch sensors and/or one or more force sensors that enable a user to provide input to the mobile device.

Each of the components of I/O module 850 may include specialized circuitry for generating signals or data. In some cases, the components may produce or provide feedback for application-specific input that corresponds to a prompt or user interface object presented on the display.

As noted above, network/communications module 860 includes one or more communication channels. These communication channels can include one or more wireless interfaces that provide communications between processor 810 and an external device or other electronic device. In general, the communication channels may be configured to transmit and receive data and/or signals that may be interpreted by instructions executed on processor 810. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 860 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the mobile device 100 to a mobile phone for output on that device and vice versa. Similarly, the network/communications module 860 may be configured to receive input provided on another device to control the mobile device. For example, an audible alert, visual notification, or haptic alert (or instructions therefor) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, or wearable devices (e.g., smartwatch or head-mounted device, such as smart glasses).

Other embodiments are in the following claims.

What is claimed is:

1. A panel audio loudspeaker, comprising:

a panel extending in a plane;

a rigid element mechanically coupled to a surface of the panel at a point;

an elongate member extending parallel to the plane and mechanically coupled to the rigid element, the elongate member extending from the rigid element to a free end of the elongate member;

a transducer mechanically coupled to the elongate member at a location between the rigid element and the free end of the elongate member, the transducer comprising a magnet and an electrically-conducting coil; and an electronic control module electrically coupled to the transducer and programmed to energize the transducer, wherein, during operation of the panel audio loudspeaker, the transducer applies forces to the elongate member sufficient to vibrate the elongate member in a direction perpendicular to the plane to generate an audio response from the panel.

2. The panel audio loudspeaker of claim 1, wherein the panel comprises a flat panel display.

3. The panel audio loudspeaker of claim 1, wherein the elongate member is coupled to the rigid element at a second end of the elongate member opposite the free end.

4. The panel audio loudspeaker of claim 1, wherein the rigid element displaces the elongate member from the surface of the panel.

5. The panel audio loudspeaker of claim 1, wherein the elongate member comprises a non-magnetic material.

6. The panel audio loudspeaker of claim 1, wherein the electrically-conducting coil is attached to the elongate member and the magnet is attached to a housing for the panel audio loudspeaker.

7. The panel audio loudspeaker of claim 1, wherein the magnet is attached to the elongate member and the electrically-conducting coil is attached to a housing for the panel audio loudspeaker.

8. The panel audio loudspeaker of claim 1, wherein the magnet is a permanent magnet.

9. The panel audio loudspeaker of claim 1, wherein the magnet is an electromagnet.

10. The panel audio loudspeaker of claim 1, further comprising one or more additional transducers, each comprising a magnet and an electrically-conducting coil, wherein, during operation of the panel audio loudspeaker, each additional transducer applies a force to the elongate member sufficient to vibrate the elongate member in a direction perpendicular to the plane.

11. The panel audio loudspeaker of claim 10, wherein each of the transducers are located at different positions with respect to the elongate member, the positions being selected based on vibrational modes of the elongate member.

12. The panel audio loudspeaker of claim 1, wherein the elongate member has a length in a range from about 1 cm to about 10 cm and a thickness of 5 mm or less.

13. The panel audio loudspeaker of claim 1, wherein the elongate member has a stiffness and is sized so that the panel audio loudspeaker has a resonance frequency in a range from about 200 Hz to about 500 Hz.

14. The panel audio loudspeaker of claim 1, wherein the elongate member comprises a beam.

15. The panel audio loudspeaker of claim 1, wherein the elongate member comprises a plate.

16. The panel audio loudspeaker of claim 1, wherein the elongate member is removably coupled to the rigid element.

17. The panel audio loudspeaker of claim 1, wherein the magnet and the electrically-conducting coil are moveable relative to each other during operation of the panel audio loudspeaker along the direction perpendicular to the plane.

18. The panel audio loudspeaker of claim 1, wherein the elongate member is a rigid elongate member.

19. A mobile device, comprising:

a housing;

a display panel mounted in the housing;

a panel extending in a plane, wherein the panel comprises the display panel;

a rigid element mechanically coupled to a surface of the panel at a point;

an elongate member extending parallel to the plane and mechanically coupled to the rigid element, the elongate member extending from the rigid element to a free end of the elongate member;

a transducer mechanically coupled to the elongate member at a location between the rigid element and the free end of the elongate member, the transducer comprising a magnet and an electrically-conducting coil; and an electronic control module electrically coupled to the transducer and programmed to energize the transducer, wherein, during operation, the transducer applies forces to the elongate member sufficient to vibrate the elongate member in a direction perpendicular to the plane to generate an audio response from the panel.

20. A wearable device comprising:

a housing;

a display panel mounted in the housing;

a panel extending in a plane, wherein the panel comprises the display panel;

a rigid element mechanically coupled to a surface of the panel at a point;

an elongate member extending parallel to the plane and mechanically coupled to the rigid element, the elongate member extending from the rigid element to a free end of the elongate member;

a transducer mechanically coupled to the elongate member at a location between the rigid element and the free end of the elongate member, the transducer comprising a magnet and an electrically-conducting coil; and an electronic control module electrically coupled to the transducer and programmed to energize the transducer, wherein, during operation, the transducer applies forces to the elongate member sufficient to vibrate the elongate member in a direction perpendicular to the plane to generate an audio response from the panel.

* * * * *